United States Patent [19]

Kobashi

[11] 4,299,600

[45] Nov. 10, 1981

[54] TRAPPER DEVICE FOR COLLECTING AND INCINERATING FINE PARTICULATES INCLUDED IN EXHAUST GAS FROM A DIESEL ENGINE

[75] Inventor: Kiyoshi Kobashi, Mishima, Japan

[73] Assignee: Toyota Jidosha Kogyo Kabushiki Kaisha, Toyota, Japan

[21] Appl. No.: 131,001

[22] Filed: Mar. 17, 1980

[30] Foreign Application Priority Data

Jan. 9, 1980 [JP] Japan ..... 55/507

[51] Int. Cl.[3] ..... F01N 3/02; F01N 3/36; F01N 3/38; F01N 7/04

[52] U.S. Cl. ..... 55/213; 55/418; 55/466; 55/484; 55/DIG. 30; 60/286; 60/291; 60/303; 60/311; 422/109; 422/111; 422/112; 422/115; 422/174; 422/176; 422/178; 422/182

[58] Field of Search ..... 422/109, 111, 112, 116, 422/168, 174, 175, 176, 177, 178, 180, 182, 183, 115; 55/269, 350, 418, 466, 484, DIG. 10, DIG. 30, 213; 60/286, 291, 303, 311, 320, 296

[56] References Cited

U.S. PATENT DOCUMENTS 3,361,350 1/1968 Genbauffe ..... 422/112 X
4,167,852 9/1979 Ludecke ..... 60/296

FOREIGN PATENT DOCUMENTS 2519609 11/1976 Fed. Rep. of Germany ..... 60/311

*Primary Examiner*—Bradley Garris
*Attorney, Agent, or Firm*—Stevens, Davis, Miller & Mosher

[57] ABSTRACT

A trapper apparatus arranged in the exhaust line of a diesel engine, provided with a pair of transversely separated trapper units and with a valve plate arranged before units for selectively introducing the exhaust gas from the engine into one of the units. The valve plate is further provided with a pair of fuel injection nozzles each of which is adapted for communicating a common fuel inlet with one of the trapper units which is closed by the valve plate.

6 Claims, 4 Drawing Figures

TRAPPER DEVICE FOR COLLECTING AND INCINERATING FINE PARTICULATES INCLUDED IN EXHAUST GAS FROM A DIESEL ENGINE

DESCRIPTION OF THE INVENTION

The present invention relates to a trapper apparatus for collecting and incinerating combustible particulates, such as carbon particulates, included in the exhaust gas emitted from a diesel type internal combustion engine.

Known is a system for collecting and incinerating fine particulates included in the exhaust gas from a diesel engine, wherein there is arranged a filter or trapper made of a porous body, such as an assembly of beads made of alumina material, foamed ceramic provided with a coating of alumina material, a mesh of metal or a honeycomb structure of ceramic material. After prolonged operation of the engine with such a known system, the trapper is clogged by the particulates in the exhaust gas but these particulates can be burnt and incinerated by generating heat in the trapper while the trapper is closed. However, closing of the trapper makes it impossible to continue the operation of the engine. Therefore, in order to continue the operation of the engine during the incinerating of the particulates, such an arrangement is known wherein a pair of trapper units are arranged side by side and a switching valve is arranged before the units. The valve is adapted to close one of the trapper units to effect the burning of the particulates therein, while the exhaust gas is passed through the other unit in order to continue the operation of the engine.

When the particulates collected in the closed trapper unit are burnt and incinerated, an amount of fuel must be introduced into the trapper unit. Therefore, in a conventional system, fuel introducing systems must be provided in the respective two trapper unit. However, this requires extra parts which increases the manufacturing cost.

An object of the present invention is to provide an improved trapper apparatus capable of burning and incinerating fine particulates in exhaust gas.

Another object of the present invention is to provide a trapper apparatus of simple construction and of low cost.

According to the present invention there is provided a trapper apparatus for fine particulates included in an exhaust gas from an internal combustion engine which comprises a casing having axially spaced apart opposing inlet and outlet ends, said inlet end being adapted for receiving the exhaust gas from the engine, said outlet end being adapted for discharging the purified exhaust gas from the casing; transversely separated first and second chambers which are arranged between said ends of the casing; a first and a second trapper unit arranged in the first and the second chambers, respectively, each of the trapper units comprising a porous material capable of collecting the fine particulates in the exhaust gas, each of the trapper units having a first open end near the inlet end of the casing and a second open end near the outlet end of the casing; a valve member arranged between the inlet end of the casing and the first and the second trapper units, said valve member being capable of moving between a first position wherein the inlet end communicates with the first trapper unit for introducing the exhaust gas into the first trapper unit and a second position wherein the inlet end communicates with the second trapper unit for introducing the exhaust gas into the second trapper unit; heater means arranged in the casing for generating a heat for burning the particulates included in the trapper units; a fuel inlet opened to the interior of the casing at a position between the inlet end of the casing and the trapper units, said fuel inlet being adapted for receiving an amount of fuel for burning the particulates collected in the trapper units, and pipe means mounted on the valve member for connecting the fuel inlet, when the valve is in its first position, with the second trapper unit, and for connecting the fuel inlet, when the valve is in its second position, with the first trapper unit, whereby fuel is introduced into closed trapper unit for burning the particulates collected therein.

Other objects and advantages of the present invention will be understood from the following description with reference to accompanying drawings in which.

Figure 1:
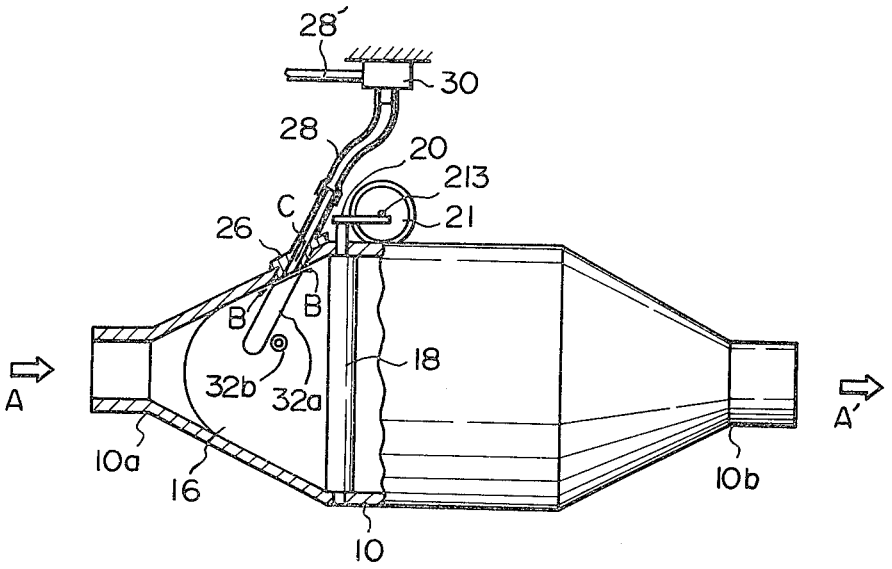
FIG. 1 is partially cut-out side view of the apparatus according to the present invention.
Figure 2:
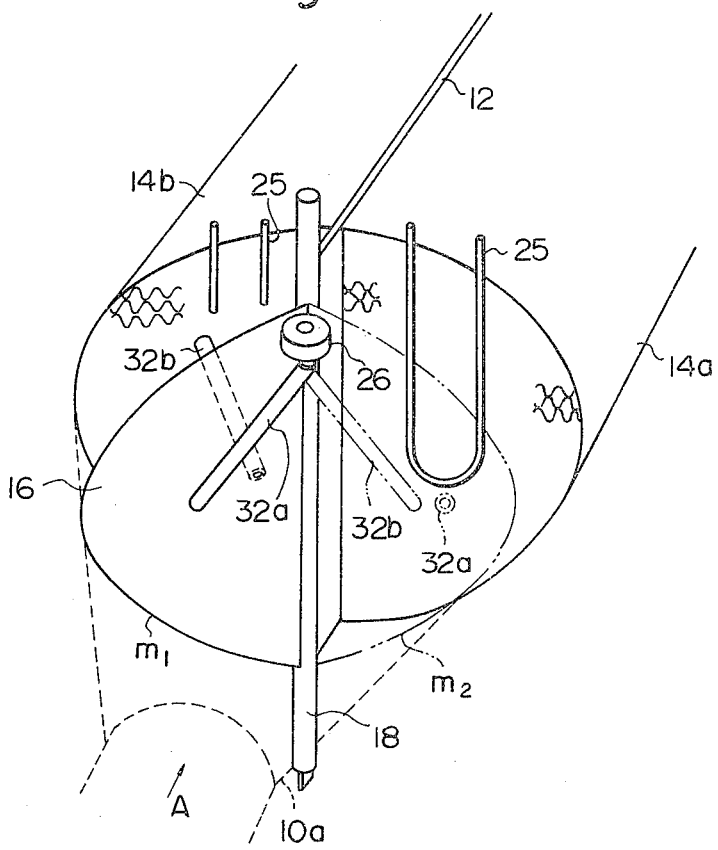
FIG. 2 is a schematic perspective view of the apparatus according to the present invention.
Figure 3:
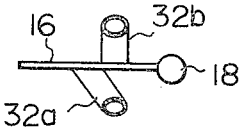
FIG. 3 is an upper elevational view of valve plate.

Referring to FIGS. 1 and 2, a reference numeral 10 designates a casing which has, along the length thereof, an inlet and 10*a* and an outlet end 10*b* of substantially conical shape. The inlet end 10*a* is connected to a not shown exhaust pipe of a diesel engine for receiving the exhaust gas in a direction indicated by an arrow A. The exhaust gas which has passed through the casing is discharged from the outlet 10*b* in a direction indicated by an arrow A'.

Figure 4:
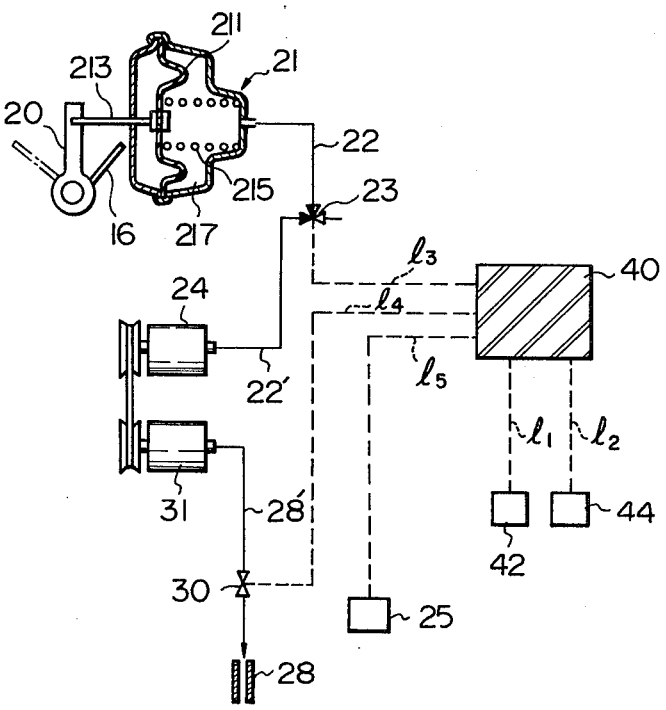
FIG. 4 illustrates an arrangement for operating the apparatus.

As illustrated in FIG. 2, a partition 12 is arranged in the casing 10 along the length thereof, so that two transversely separated chambers are formed on the sides of the partition 12. A first trapper unit 14*a* is arranged in one of the chambers, while a second trapper unit 14*b* is arranged in the other chamber. Each of the trapper units 14*a* and 14*b* is made of porous material, such as a foamed ceramic material. Each of the units 14 and 14*b* is also provided with opposed open ends, one of which faces the inlet 10*a* of the casing and the other of which faces the outlet end 10*b* of the casing. A valve plate 16 is arranged before the trapper units 14*a* and 14*b* for selectively introducing the exhaust gas from the inlet 10*a* into the trapper 14*a* or 14*b*. The valve plate 16 is moved between a first position (solid line $m_1$) in which the first trapper 14*a* is opened for receiving the exhaust gas while the second trapper 14*b* is closed and a second position (phantom line $m_2$) in which the second trapper 14*b* is opened for receiving the exhaust gas while the first trapper 14*a* is closed. In order to effect the movement of the valve plate 16, it is fixedly connected to a shaft 18 which is rotatable with respect to the casing 10. Further, the shaft 18 has, at an upper end projected out of casing, a lever 20 to which an actuator 21 is associated. The actuator 21 has, as shown in FIG. 4, a diaphragm 211 which is connected to the lever 20 via a rod 213. A spring 215 urges the diaphragm 211 so that the lever 20 is moved away from the actuator 21. Thus, the valve plate 16 is moved between the first position (solid line) and second position (phantom line) by selectively introducing a vacuum signal into a vacuum operating chamber 217 formed on one side of the diaphragm remote from the lever 20. The chamber 217 is connected, via a vacuum line 22, an electromagnetic switching valve 23 and a vacuum line 22', to a vacuum pump 24 driven by a not shown crankshaft of the engine. Therefore, a vacuum signal from the pump 24 is transmitted to the vacuum operating chamber 217 when the switching valve 23 is open.

As shown in FIG. 2, heaters 25 of substantially U shape are arranged before the inlet opening of each of the trapper units 14*a* and 14*b*. These heaters are adapted for generating heat for burning the particulates collected by the trappers 14*a* and 14*b*.

According to the present invention, a system is further provided with a fuel system for supplying, when the particulates collected in the trapper unit 14*a* or 14*b* are to be incinerated, an amount of fuel capable of completely burning the particulates. The system is comprised of a fuel inlet 26 mounted on the upper portion of the conical portion 10*a* so that the fuel inlet 26 is opened to the interior of the casing 10. The fuel inlet 26 is connected, via a fuel tube 28, a fuel injection valve 30 and a fuel tube 28', to a fuel pump 31 (FIG. 4) operated by the not shown crankshaft of the engine. Therefore, an amount of fuel from the pump 31 is directed to the fuel inlet mouth 26 when the fuel injection valve 30 is open.

As illustrated in FIG. 2, the apparatus is further provided with a first fuel injection nozzle 32*a*, a lower end of which is connected to one side of the valve plate 16 and a second fuel injection nozzle 32*b*, a lower end of which is connected to the other side of the plate 16. The first injection nozzle 32*a* is inclined with respect to the plate 16 so that the upper end of the nozzle 32*a* is aligned with the fuel inlet 26 when the valve plate 16 is in its first position (solid line), allowing the fuel to be introduced into the closed second trapper unit 14*b*. The second nozzle 32*b* is inclined with respect to the valve plate 16 so that the upper end of the nozzle 32*b* is aligned with the mouth 26 when the plate 16 is in its second position (phantom line), allowing the fuel to be directed to the closed first trapper unit 14*a*.

When the fuel injection nozzle 32*a* communicates, at the upper end thereof, with the fuel inlet 26, a small gap is formed therebetween as shown in FIG. 2. Therefore, a controlled amount of exhaust gas including air is sucked into the nozzle 32*a*, as indicated by arrows B, together with the fuel directed from the fuel inlet 26, as indicated by an arrow C, so that the exhaust gas including air and the fuel is well mixed in the nozzle 32*a*. This mixing operation similary occurs in the second fuel injection nozzle 32*b* when it communicates with the fuel injection mouth 26.

In FIG. 4, a reference numeral 40 indicates an electrical control unit which may be formed as a programmed computer. The electrical control unit 40 receives, via an electrical line $l_1$, electrical signals from a back pressure sensor 42, and receives, via an electrical line $l_2$, electrical signals from a sensor 44 for detecting an operating condition of the engine (such as the load and/or rotational speed of the engine). The electrical control unit 40 supplies electrical signals to the electro-magnetic valve 23, the fuel injection valve 30 and the heater device 25 via electrical lines $l_3$, $l_4$ and $l_5$, respectively.

The trapper device according to the present invention operates as follows.

When the valve plate 16 is in its first position (solid line $m_1$), the exhaust gas received by the inlet 10*a* in the direction indicated by the arrow A is introduced into the first trapper unit 14*a*, whereas the second trapper unit 14*a* cannot receive the exhaust gas. It should be noted that, in order to obtain the first position of the valve plate 16, the electro-magnetic valve 23 (FIG. 4) must be open, whereby the vacuum chamber 217 is connected to the vacuum pump 24.

The particulates, such as carbon, included in the exhaust gas are collected by the one trapper 14*a* through which the exhaust gas is passed. As long as the trapper 14*a* has the ability to effectively collect the particulates in the exhaust gas, the heater device 25 is not operated.

When the trapper 14*a*, through which the exhaust gas is passed, is clogged by particulates collected therein, the back pressure in the exhaust pipe of the engine become high. Therefore, the back pressure sensor 42 provides electrical signals received by the electrical control unit 40 via the line $l_1$, and the unit 40 provides electrical signals transmitted to the electro-magnetic valve 23. Therefore, the valve 23 is switched to the closed condition, by which the vacuum chamber 217 is disconnected from the vacuum pump 24. Thus, the valve plate 16 is, under the action of the spring 215, switched to the second position (phantom line), by which the first and clogged trapper 14*a* is closed while the second and fresh trapper 14*b* is opened. As a result of this, the exhaust gas received by the inlet 10*a* is now introduced into the second trapper unit 14*b* for collecting the particulates. It should be noted that, in this second position of the valve plate, the second fuel injection nozzle 32*b* is, at its upper end, communicated with the fuel inlet 26 on the casing 10.

Then, the control unit 40 provides the electrical signal for energizing the heater 25 corresponding to the closed and clogged trapper unit 14*a*. At the same time, the control unit 40 provides the electrical signal for opening the fuel injection valve 30. An amount of fuel from the fuel pump 31 is, via the inlet, introduced into the fuel nozzle 32*b* and mixed with the air included in the exhaust gas sucked into the nozzle 32*b* via a slit formed between the nozzle 32*b* and the fuel inlet 26. The thus formed mixture is discharged toward the trapper unit 14*a* under an atomized condition. The discharged fuel is, under the influence of the heat generated by the energized heater 25, ignited, which causes to burn the combustible particulates included in the trapper unit 14*a*. After a predetermined sufficient time required for completely burning and incinerating the particulates in the trapper unit 14*a* has lapsed, the trapper unit 14*a* is refreshed and computer 40 provides signals for de-energization of the heater 25 and the fuel injection valve 30.

When a predetermined time has lapsed after the valve plate 16 is switched to the second position in order to open the second trapper 14*b* to the inlet, the trapper 14*b* will become clogged by the particulates. The clogging of the trapper 14*b* through which the exhaust gas is passed is detected by the back pressure sensor 42. The control unit 40 then produces an electrical signal transmitted to the electro-magnetic valve 23, so that it is switched to the open condition, by which a vacuum signal from the vacuum pump 24 is connected to the vacuum chamber 217. Thus, the valve plate 16 is switched, against the force of the spring 215, to the first position (solid line). Therefore, the second trapper unit 14*b*, which is clogged by the particulates, is closed and the fresh trapper 14*a* is opened, allowing the exhaust gas to be introduced into the trapper unit 14*a*. At the same time the first fuel injection pipe 32*a* is connected at the upper end thereof to the fuel inlet 26.

Then, the control unit 40 produces the electrical signal for energizing the heater 25 corresponding the clogged trapper unit 14*b* and the electrical signal for opening the fuel injection valve 30. Thus, an amount of fuel together with the exhaust gas including air is, under the same principle as already described, directed to the trapper 14*b* for burning and incinerating the particulates included therein. Thus, the second trapper unit 14*b* is refreshed.

As will be clear from the above description, the valve plate 16 is, according to the present invention, provided with two fuel injection nozzles 32*a* and 32*b*, which are selectively connected to the common fuel inlet 26 in accordance with the position of the valve plate 16. Therefore, the present invention makes it possible to supply fuel to the two trapper units 14*a* and 14*b* by utilizing only one fuel system. This reduces the cost of the apparatus as well as simplifies the construction of the apparatus.

While the present invention has been described with reference to a specific embodiment, many modifications and changes can be made by those skilled in the art without departing from the scope of the present invention.

I claim:

1. A trapper apparatus for fine particulates included in an exhaust gas from an internal combustion engine, comprising:

a casing having axially spaced opposing inlet and outlet ends, said inlet end being adapted for receiving the exhaust gas from the engine, said outlet end being adapted for discharging the purified exhaust gas from the casing;

first and second chambers which are arranged between said ends of the casing;

a first and a second trapper unit arranged in the first and the second chambers, respectively, each of the trapper units comprising a porous material capable of catching the fine particulates in the exhaust gas, each of the trapper units having a first open end near the inlet end of the casing and a second open end near the outlet end of the casing;

a valve member arranged between the inlet end of the casing and the first and the second trapper units, actuator means for moving said valve member between a first position wherein the inlet end communicates with the first trapper unit for introducing the exhaust gas into the first trapper unit and a second position wherein the inlet end communicates with the second trapper unit for introducing the exhaust gas into the second trapper unit;

heater means arranged in the casing for generating a heat for burning the particulates included in the trapper units;

a fuel inlet opened to the interior of the casing at a position between the inlet end of the casing and the trapper units, said fuel inlet being adapted for receiving an amount of fuel for burning the particulates collected in the trapper units;

pipe means mounted on the valve member for aligning the fuel inlet, when the valve member is in its first position, with the second trapper unit, and for aligning the fuel inlet, when the valve member is in its second position, with the first trapper unit, whereby fuel is introduced into a closed trapper unit for burning the particulates therein, and;

sucking means which sucks a controlled amount of exhaust gas and air into said pipe means.

2. A trapper apparatus according to claim 1, wherein said pipe means comprise a pair of fuel injection nozzles of pipe shape which are fixedly connected to the respective sides of the valve member, one of which nozzles communicates at one end with the fuel inlet and at the other end with the second trapper unit when the valve member is in its first position, the other of which nozzles communicates at one end with the fuel inlet and at the other end with the first trapper unit when the valve member is in its second position.

3. A trapper apparatus according to claim 2, wherein said sucking means comprises a small gap formed between the fuel inlet and one of the fuel injection nozzles communicating with the fuel inlet, whereby a controlled amount of the exhaust gas including excess air is introduced into said one of the fuel injection nozzles.

4. A system for purifying exhaust gas in an exhaust line of a diesel engine, comprising:

a casing arranged in the exhaust line;

first and second trapper units arranged in the casing, each of which comprises a porous material having an ability for collecting fine particulates included in the exhaust gas;

a valve member arranged upstream of the trapper units, said valve member being capable of moving between a first position wherein the exhaust gas is directed to the first trapper unit and a second position wherein the exhaust gas is directed to the second trapper unit;

actuator means for moving the valve member between the first and the second positions;

heater means arranged in the casing for generating heat for burning the particulates in the trapper units;

a fuel inlet opened to interior of the casing at a position before the trapper units;

a fuel supply line connecting the fuel inlet to a fuel source;

a fuel injection valve means arranged on the fuel supply line;

a first injection nozzle mounted to the valve member for aligning the fuel inlet, when the valve member is in its first position, with the second trapper unit;

a first small air gap being formed between the first nozzle and the fuel inlet when the fuel inlet is aligned with the second trapper unit;

a second injection nozzle mounted to the valve member for aligning the fuel inlet, when the valve member is in its second position, with the first trapper unit;

a second small air gap being formed between the second nozzle and the fuel inlet when the fuel inlet is aligned with the first trapper unit;

means for sensing operating conditions of the engine and for providing electrical signals indicating that one of the trapper units through which the exhaust gas is passed is clogged;

controlling means responsive to said signals for operating, in a predetermined sequence, the actuator means for moving the valve member between the first and second positions, the heater means for generating heat in the clogged trapper unit, and the fuel injection valve means for introducing a predetermined amount of fuel into the clogged trapper unit, whereby the particulates collected by the trapper unit are burnt are incinerated.

5. In a system for purifying the exhaust gas of a diesel engine comprising a casing provided with a first and a second trapper unit arranged in an exhaust line of the engine, a valve member for selectively introducing exhaust gas into one of the trapper units, heater means, and a fuel supply device for introducing an amount of fuel to burn the particulates collected in the trapper unit which is closed by the valve member, the improvement comprising the fuel supply device having a common fuel inlet mounted to the casing and connected to a fuel supply, and having a pair of fuel injection nozzles fixed to the valve member, one of said nozzles communicating the fuel inlet with the first trapper unit via a small air gap between the nozzle and the inlet when the exhaust gas is directed to the second trapper unit, the other of said nozzles communicating the fuel inlet with the second trapper unit via a small air gap between the nozzle and the inlet when the exhaust gas is directed to the first trapper unit.

6. A trapper apparatus for fine particulates included in an exhaust gas from an internal combustion engine, comprising:

a casing having axially spaced opposing inlet and outlet ends, said inlet end being adapted for receiving the exhaust gas from the engine, said outlet end being adapted for discharging the purified exhaust gas from the casing;

first and second chambers which are arranged between said ends of the casing;

a first and a second trapper unit arranged in the first and the second chambers, respectively, each of the trapper units comprising a porous material capable of catching the fine particulates in the exhaust gas, each of the trapper units having a first open end near the inlet end of the casing and a second open end near the outlet end of the casing;

a valve member arranged between the inlet end of the casing and the first and the second trapper units; actuator means for moving said valve member between a first position wherein the inlet end communicates with the first trapper unit for introducing the exhaust gas into the first trapper unit and a second position wherein the inlet end communicates with the second trapper unit for introducing the exhaust gas into the second trapper unit;

heater means arranged in the casing for generating a heat for burning the particulates included in the trapper units;

a fuel inlet opened to the interior of the casing at a position between the inlet end of the casing and the trapper units, said fuel inlet being adapted for receiving an amount of fuel for burning the particulates collected in the trapper units;

a pair of fuel injection nozzles of pipe shape which are fixedly connected to the respective sides of the valve member, one of which nozzles communicates at one end with the fuel inlet and at the other end with the second trapper unit when the valve member is in its first position, the other of which nozzles communicates at one end with the fuel inlet and at the other end with the first trapper unit when the valve member is in its second position; and a small gap being formed between the fuel inlet and one of the fuel injection nozzles communicating with the fuel inlet, whereby a controlled amount of the exhaust gas including excess air is introduced into said one of the fuel injection nozzles.

* * * * *